US007150381B2

(12) United States Patent
Goldman

(10) Patent No.: US 7,150,381 B2
(45) Date of Patent: Dec. 19, 2006

(54) GARMENT HANGER WITH NON-SLIP PADS

(75) Inventor: Allan Joel Goldman, Wayne, NJ (US)

(73) Assignee: Uniplast Industries, Inc., Hasbrouck Heights, NJ (US)

( * ) Notice: Subject to any disclaimer, the term of this patent is extended or adjusted under 35 U.S.C. 154(b) by 476 days.

(21) Appl. No.: 10/713,542

(22) Filed: Nov. 14, 2003

(65) Prior Publication Data

US 2005/0184109 A1 Aug. 25, 2005

(51) Int. Cl.
*A41D 27/22* (2006.01)

(52) U.S. Cl. ..... 223/91; 223/93; 223/96

(58) Field of Classification Search ..... 223/85, 223/90–93, 95–97, DIG. 2
See application file for complete search history.

(56) References Cited

U.S. PATENT DOCUMENTS

| | | | | |
|---|---|---|---|---|
| 2,535,521 | A | 12/1950 | Schoepfer | |
| 4,115,940 | A | 9/1978 | Phillips | |
| 4,194,274 | A | 3/1980 | Garrison | |
| 4,231,500 | A | 11/1980 | Mainetti | |
| 4,450,639 | A | 5/1984 | Duester | |
| 4,658,996 | A | 4/1987 | Warmath | |
| D298,387 | S | 11/1988 | Duester | |
| D299,086 | S | 12/1988 | Wilson | |
| 4,878,276 | A * | 11/1989 | Morrish et al. | 24/511 |
| D316,334 | S | 4/1991 | Duester | |
| 5,020,705 | A | 6/1991 | Garrison | |
| 5,183,191 | A | 2/1993 | Garrison | |
| 5,516,014 | A | 5/1996 | Garrison | |
| 5,890,634 | A | 4/1999 | Zuckerman | |
| 6,199,728 | B1 * | 3/2001 | Cohen | 223/96 |
| 6,306,329 | B1 * | 10/2001 | Willinger | 264/255 |
| 6,382,479 | B1 * | 5/2002 | Zuckerman | 223/96 |
| 6,612,000 | B1 * | 9/2003 | Housley | 24/510 |
| 2004/0065702 | A1 * | 4/2004 | Yang | 223/96 |

FOREIGN PATENT DOCUMENTS

| | | |
|---|---|---|
| FR | 2 592 291 | 7/1987 |

* cited by examiner

*Primary Examiner*—Gary L. Welch
(74) *Attorney, Agent, or Firm*—Darby & Darby

(57) ABSTRACT

A garment hanger, according to one exemplary embodiment, includes a cross-bar having first and second ends and a hook member coupled to the cross-bar to permit hanging of the garment hanger. A first clamp assembly is disposed at the first end of the cross bar and a second clamp assembly is disposed at the second end of the cross-bar. Each of the first and second clamp assemblies includes first and second clamp members that are pivotably coupled to one another and urged toward one another by a biasing element; with each of the first and second clamp members having an inner clamp surface that has a pair of locking posts extending outwardly from the inner clamp surface. Each locking post has a locking feature formed at a distal end thereof with a resilient pad being coupled to each inner clamp surface in a removable manner by inserting the locking features of the locking posts into and through complementary openings formed in the resilient pad such that the resilient pad is securely held on the inner clamp surface by an interference fit between the locking features and one face of the resilient pad.

31 Claims, 4 Drawing Sheets

GARMENT HANGER WITH NON-SLIP PADS

TECHNICAL FIELD

The present invention relates generally to garment hangers, and more particularly to a garment hanger with clamp assemblies that include non-slip surfaces for positively gripping garments.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles which have different types of construction to accommodate different articles which are carried by the hangers.

For example, one type of garment hanger construction is designed to secure knitwear, blouses, slips, strapped garments, including dresses and lingerie. Another type of garment hanger construction is designed to also secure blouses, dresses and other light garments, while another type of garment hanger is designed to secure heavier knitwear, blouses, pants and light weight pant suits. Yet another type of garment hanger is designed to secure coats, jackets and outerwear. The foregoing types of garment hangers can be generally classified as being top garment hangers, while another class of garment hangers is pant hangers, which are those hangers that are designed to secure pants, skirts, and other outfits together. Often times, pant hangers incorporate some type of clamping mechanism to securely grasp and hold the articles of clothing. One will appreciate that there are even more types of garments hangers (e.g., bra/panty hanger) that are intended for particular applications. It will be appreciated that clamp type hangers are not limited to pant hangers but rather a large number of other types of hangers utilize clamps to grip and hold the cloths.

A common problem associated with today's clamp type garment hangers is that the garments slip through the clamp assemblies and then fall onto the ground at an unacceptable frequency. The garment may slip through the clamps fairly soon after being clamped or the garment may fall after being initially held by the clamps for a short period but in either event, the result is unsatisfactory in that the garment falls to the ground. The problem is particularly annoying when expensive, fine clothing is the article which falls from the clamps onto the ground where it becomes soiled or perhaps damaged.

In order to overcome this problem, garment hangers have been constructed such that the clamp type garment hangers have clamps that have rough surfaces or sharp edges as a part thereof for gripping of the garment. While this may yield some satisfactory results, the rough surfaces of the clamps can do damage to delicate fabrics that are gripped by the clamps. For example, silks or linens can become damaged when they are held between the clamps due to the makeup of these fabrics. This is unacceptable not only to the owners of the fabric articles but also to manufacturers and retailers who ship and then display the fabric articles, respectively, for purchase by consumers.

It is therefore desirable to provide a garment hanger that is constructed so that a clamp assembly thereof has a clamping surface that is both smooth to the touch and has the ability to positively grip the garments for extended period of time.

SUMMARY

A garment hanger, according to one exemplary embodiment, includes a cross-bar having first and second ends and a hook member coupled to the cross-bar to permit hanging of the garment hanger. A first clamp assembly is disposed at the first end of the cross bar and a second clamp assembly is disposed at the second end of the cross-bar. Each of the first and second clamp assemblies includes first and second clamp members that are pivotably coupled to one another and urged toward one another by a biasing element; with each of the first and second clamp members having an inner clamp surface that has a pair of locking posts extending outwardly from the inner clamp surface. Each locking post has a locking feature formed at a distal end thereof.

A resilient pad is coupled to each inner clamp surface in a removable manner by inserting the locking features of the locking posts into and through complementary openings formed in the resilient pad such that the resilient pad is securely held on the inner clamp surface by an interference fit between the locking features and one face of the resilient pad. In one embodiment, the locking feature acts to pinch the resilient pad and hold it in place between the locking feature and the inner clamp surface.

In one embodiment, the resilient pad includes a base section for contacting and gripping a garment and a pair of flexible flange-like end sections that are integral to the base section. The locking apertures are formed in the flange-like end sections and receive the locking feature which is in the form of an enlarged protrusion at the end of the locking post. The material of the resilient pad is selected so that its coefficient of friction is sufficiently high to preclude movement under the weight of the garment when a normal clamping force is applied to the two clamping members to move them into a clamping position. In one embodiment, the garment contacting portion of the resilient pad is formed of a resilient friction material that comprises a block copolymer having discreet block segments of styrene monomer units and rubber monomer units.

Further aspects and features of the exemplary apparatus disclosed herein can be appreciated from the appended Figures and accompanying written description.

BRIEF DESCRIPTION OF THE DRAWINGS

The invention will be more fully understood by reference to the following drawings which are for illustrative purposes only.

DETAILED DESCRIPTION OF THE PREFERRED EMBODIMENTS

Figure 1:
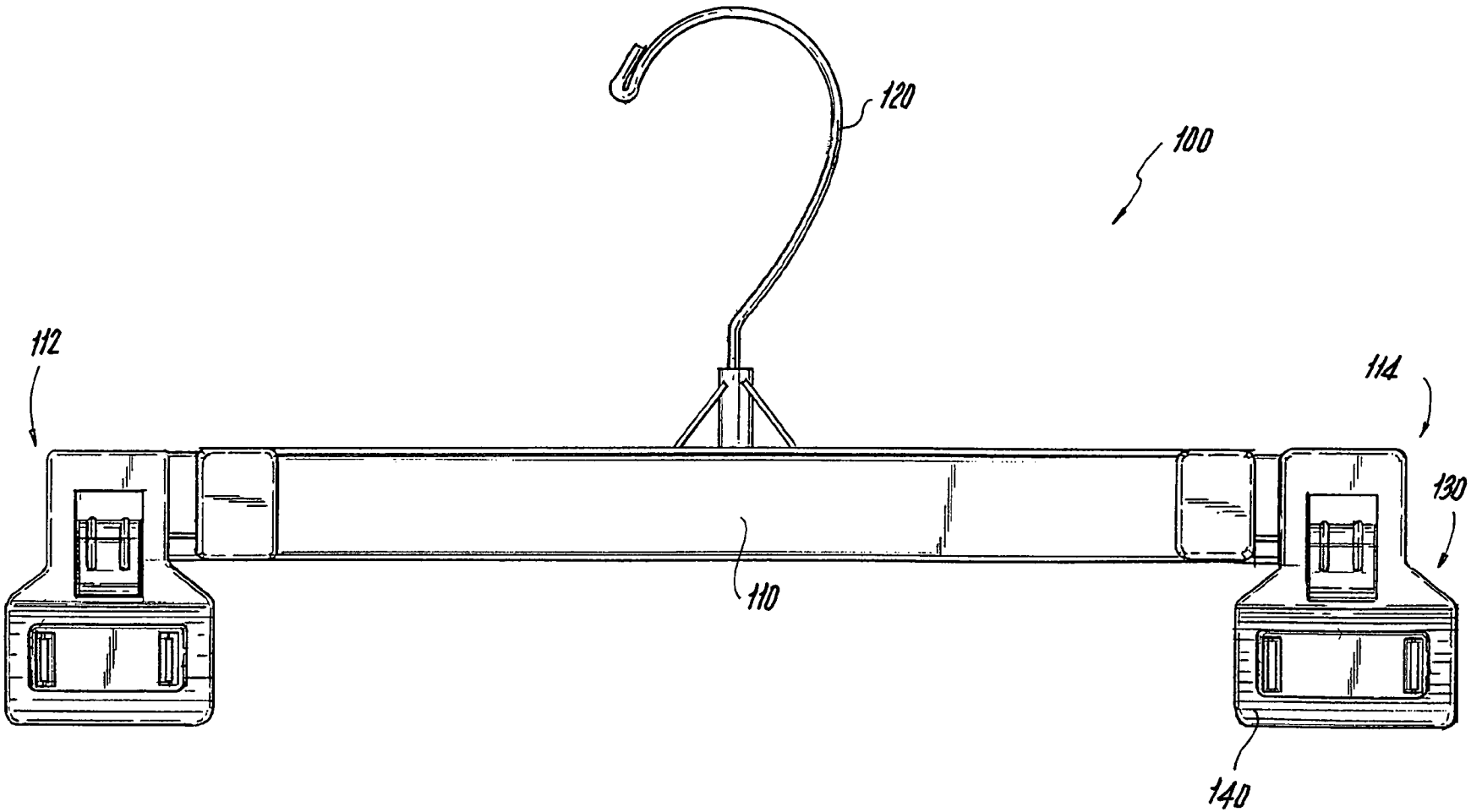
FIG. 1 is a side elevation view of a garment hanger in accordance with a first exemplary embodiment.

Referring first to FIGS. 1–8, a garment hanger 100 according to one exemplary embodiment is illustrated. The garment hanger 100 includes a body portion 110 (cross bar) having two opposing ends 112, 114 and a hook member 120 that is attached to the body portion 110. The exemplary garment hanger 100 is of the type that includes a clamp or grip assembly 130 formed at each of the first and second ends 112, 114. At least some of the grip assemblies 130 are integrally formed with body portion 110 at the first and second ends 112, 114. Each grip assembly 130 includes a front clamp member 140 and a rear clamp member 150 with the front clamp member 140 having a first gripping feature 160 and the rear clamp member 150 having a second gripping feature 160. The article of clothing is placed between the front and rear clamp members 140, 150 when they are opened and then the user closes the front clamp member 140 with respect to the rear clamp member 150. Preferably, the rear clamp members 150 are attached to the body portion 110 in an integral manner.

Figure 2:
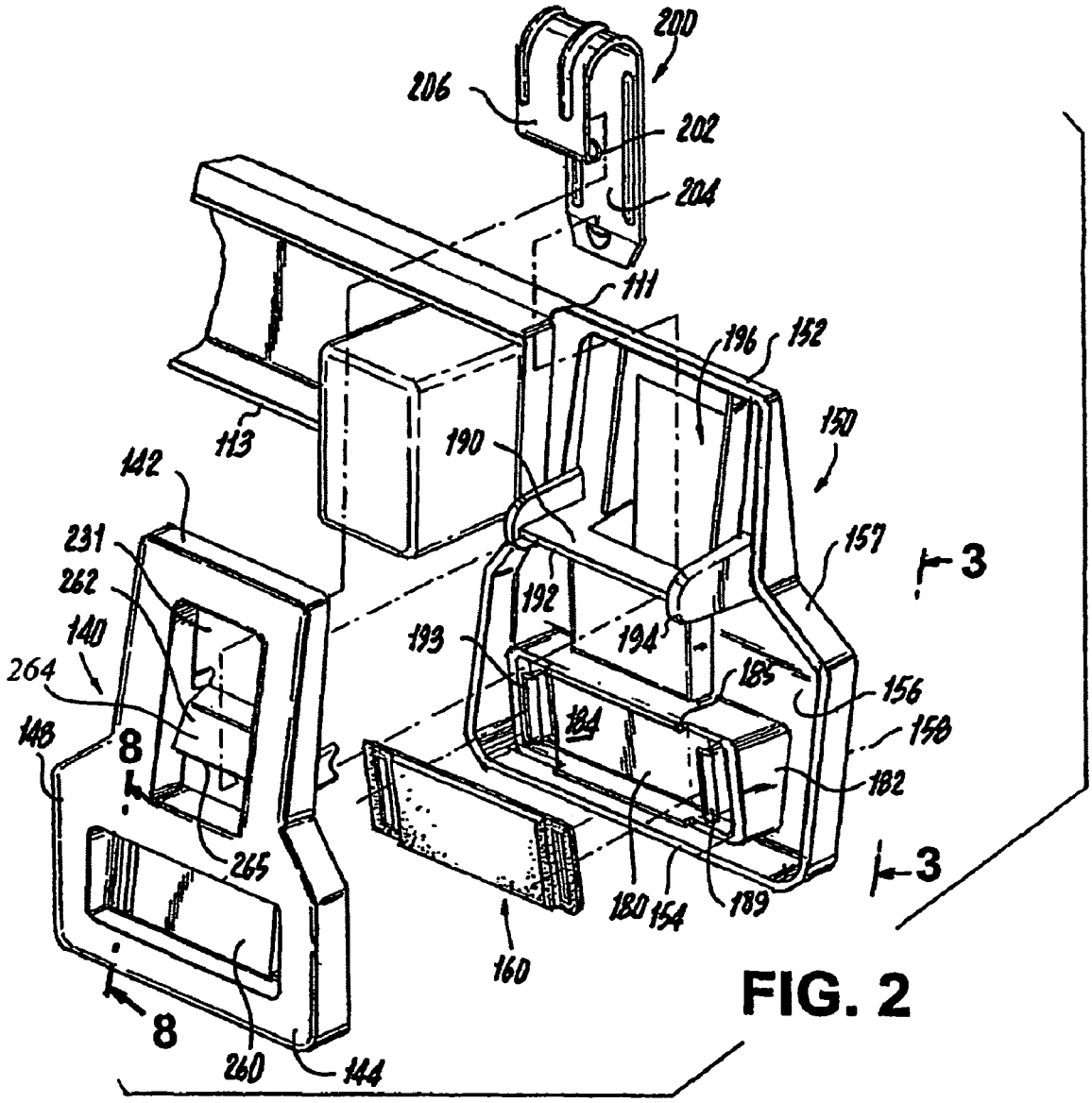
FIG. 2 is an exploded perspective view of one clamp assembly of the hanger of FIG. 1.
Figure 3:
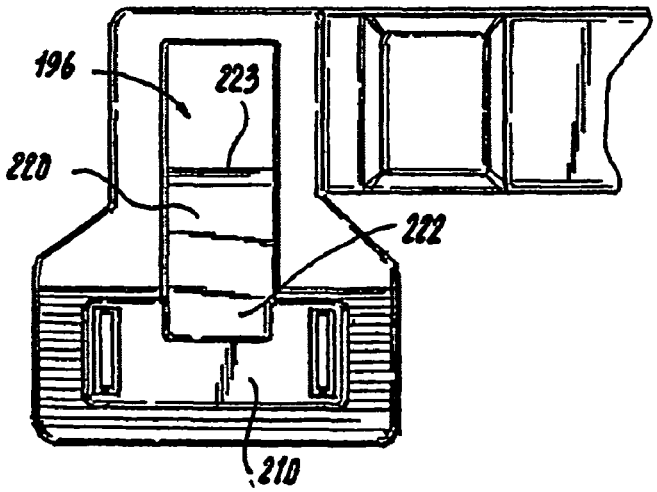
FIG. 3 is a side elevation view of the clamp assembly as viewed in the direction of line 3—3 of FIG. 2.

As shown in FIGS. 2–3, each of the rear clamp members 150 has a top end 152 and a bottom end 154 with the top end 152 lying in the plane that contains an upper edge 111 of the body portion 110. The rear clamp member 150 also includes a front face 156 that faces the front clamp member 140 and an opposing rear face 158. Below a lower edge 113 of body portion 110, the rear clamp member 150 has an enlarged section in that the width of rear clamp member 150 increases towards the bottom end 154. The rear clamp member 150 has tapered edges 157 that lie below the lower edge 113 of the body portion 110. The front face 156 of the rear clamp member 150 includes a number of features to permit the front clamp member 140 to be pivotably coupled thereto and to permit the second gripping feature 160 to be removably coupled thereto.

More specifically, the front face 156 of the rear clamp member 150 has a raised platform 180 that protrudes outwardly therefrom and is formed near the bottom end 154. Since the bottom end 154 of the rear clamp member 150 is slightly angled inward, a vertical base wall 182 of the platform 180 has varying height so that the raised platform 180 has a planar floor 184 that is generally parallel to the body portion 110. The platform 180 has a lip 185 that extends around the platform 180 for locating and holding a member in place thereon as will be described hereinafter. Accordingly, in the exemplary embodiment, the lip 185 has a rectangular shape. The platform 180 also has a pair of slots or openings 188 formed therethrough with one slot 188 being formed at one end of the platform 180 adjacent one end of the lip 185 and the other slot 188 being formed at the other end of the platform 180 adjacent the other end of the lip 185. The slot 188 does not extend completely from a top edge of the lip 185 to a bottom edge of the lip 185 but rather, a small portion of the platform 180 exists between the top edge of the slot 188 and the top edge of the lip 185 as well as between the bottom edge of the slot 188 and the bottom edge of the lip 185.

A pair of retaining posts 189 are formed as part of the rear clamp member 150 and more specifically, each post 189 includes a base section (vertical wall) 191 that is formed within the slot 188 and extends from the top edge of the slot to the bottom edge of the slot. The base section 191 is preferably centrally located within the slot 188 and is in the form of an upstanding vertical wall that extends outwardly away from the planar floor 184. In one exemplary embodiment, the post 189 has a tapered construction in that the width thereof gradually increases as the post 189 extends outwardly away from the planar floor 184. At a distal end of the post 189 opposite the end which is attached to the floor 184, the post 189 terminates in a head 193. The head 193 has a width that is greater than the distal end of the tapered post 189 so that the head 193 extends beyond and overhangs the post 189. The head 193 preferably has a non-planar construction to facilitate the insertion of a member on the posts 189 as will be described in greater detail hereinafter. For example, the head 193 can have a rounded or beveled shape. In the exemplary embodiment, the head 193 takes the appearance of a mushroom in that it has an arcuate shape with ends thereof being turned down towards the floor 184. The head 193 thus has a smooth surface to permit the member that is received thereon to ride along the surface of the head 193.

The width of the head 193 is less than a width of the slot 188 so that a small space is formed between the sides of the head 193 and the respective side edges of the slot 188. This space on either side of the post 189 permits some flexing or movement of the post 189 during insertion and/or removal of the member that is to be retained thereon. In addition, the head 193 and the post 189 are preferably an integral single member (e.g., a molded or extruded plastic member). It will be appreciated that the slot 188 and the post 189 and head 193 are not limited to having the illustrated shapes and instead they can come in any number of other shapes. The shape of the platform 180, more specifically, the planar floor 184 thereof, does have to be complementary to the shape of the second gripping feature 160.

The front face 156 of the rear clamp member 150 also includes a vertical wall 190 that extends outwardly therefrom and is formed between the platform 180 and the top end 152. The vertical wall 190 terminates preferably in a rounded edge 192 that serves as a pivot surface as will be described hereinafter. The vertical wall 190 is formed slightly above the lower edge 113 of the body portion 110 and above the tapered edges 157 of the rear clamp member 150. At either end of the vertical wall 190, a protrusion or stop 194 is formed.

The rear clamp member 150 also has an opening 196 that is formed therethrough near the top end 152 and above the vertical wall 190 for receiving a clip member 200 as will be described hereinafter.

The rear face 158 of the rear clamp member 150 has a number of recessed sections formed as part thereof. For example, a first recessed section 210 is formed and represents the underside of the platform 180 and therefore, the first recessed section 210 has substantially the same shape as the platform 180. The rear face 158 has a second recessed section 220 that includes the opening 196 at an end near the top end 152 and a planar surface 222 that extends into the first recessed section 210. In other words, the second recessed section 220 is in the form of a recessed channel that leads into the first recessed section 210. The second recessed section 220 is constructed so that it receives a portion of the clip member 200 and since the first and second recessed sections 210, 220 are in communication with one another, a free end the clip member 200 can extend into the first recessed section 210 while the clip member 200 lies in the first recessed section 210 along the planar surface 222. One side of the vertical wall 190 is cut away to permit a rounded sloped surface 223 to extend from the planar surface 222 to the side wall of the vertical wall 190. This sloped surface 223 accommodates the clip member 200.

Figure 4:
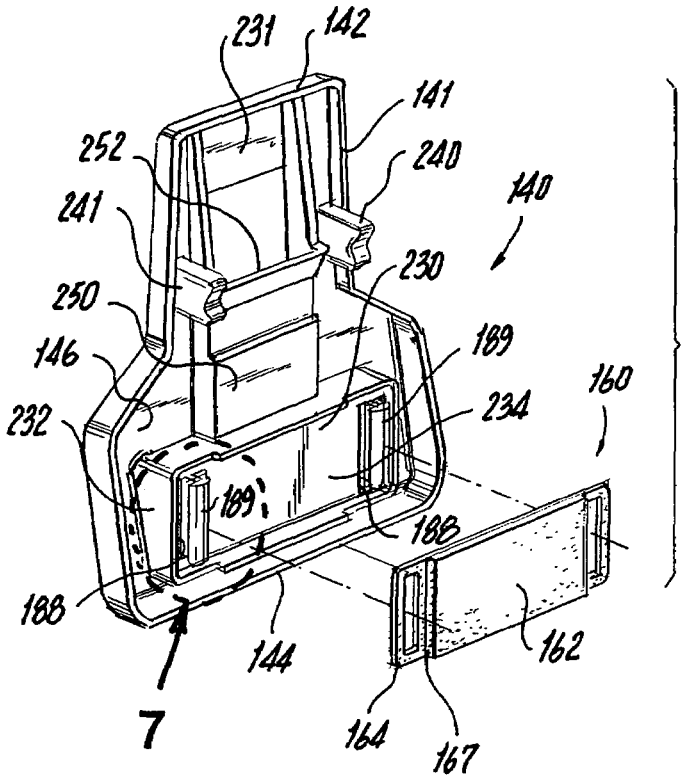
FIG. 4 is an exploded perspective view of a front clamp member of the clamp assembly of FIG. 2 with a resilient pad.

As shown in FIGS. 2–4, the front clamp member 140 is similar to the rear clamp member 150 except that it is a separate independent part in relation to the body portion 110. More specifically, the front clamp member 140 has a top end 142 and a bottom end 144. The front clamp member 140 also includes a front face 146 that faces the rear clamp member 150 and an opposing rear face 148. The front clamp member 140 has side edges 141 that are parallel to one another at the top end 142 and then taper outwardly in an intermediate section before then being parallel to one another below the tapered section and to the bottom end 144. The lower portion of the front clamp member 140 is slightly angled inward toward the rear clamp member 150 when the two members 140, 150 are coupled to one another by the clip member 200.

The front face 146 of the front clamp member 140 includes a number of features to permit the rear clamp member 150 to be pivotably coupled thereto and to permit the first gripping feature 160 to be removably coupled thereto. More specifically, the front face 146 of the front clamp member 140 has a raised platform 230 that protrudes outwardly therefrom and is formed near the bottom end 144. The raised platform 230 is very similar to the platform 180 and in some embodiment may be identical to the platform 180. A vertical base wall 232 of the platform 230 has varying height so that the raised platform 230 has a planar floor 234 that is generally parallel to the body portion 110 and to the planar floor 184 of the platform 180. The platform 230 has a lip 235 that extends around the platform 230 and further it has a pair of slots or openings 188 formed therethrough. In the illustrated embodiment, the platform 230 has a generally rectangular shape and the slot 188 has a rectangular shape as well. In addition, a pair of first posts 189 (retaining posts) are formed with heads 193 being formed at the distal ends of the posts 189.

The front face 146 of the front clamp member 140 also includes a pair of second posts 240 that extend outwardly therefrom. Distal ends 241 of the second posts 240 are cradle shaped so as to receive the rounded edge 192 of the vertical wall 190. More specifically, the distal ends 241 of the second posts 240 are defined by a pair of spaced fingers with a recessed section formed therebetween into which the rounded edge 192 is received. The distance between the second posts 240 is less than the distance between the stops 194 to permit the distal ends 241 of the second posts 240 to seat against the vertical wall 190 at locations between the stops 194.

The front face 146 of the front clamp member 140 also includes another raised structure 250 that is disposed between the raised platform 230 and an opening 231 formed in the front clamp member 140 near the top end 142. The raised structure 250 extends from one end of the raised platform 230 and terminates in a beveled edge 252 at an opposite end thereof. The beveled edge 252 terminates in a free end that is disposed between the posts 240. The opening 231 serves to receive the clip member 200 in the same manner as the opening 196 formed through the rear clamp member 150.

The rear face 148 of the front clamp member 140 has a number of recessed sections formed as part thereof. For example, a first recessed section 260 is formed and represents the underside of the platform 230 and therefore, the first recessed section 260 has substantially the same shape as the platform 230. The rear face 148 has a second recessed section 262 that includes the opening 231 at an end near the top end 142 and a floor 264 that is preferably non-planar in construction. More specifically, the floor 264 provides a support and locking surface for one free end of the clip member 200 which is received through the opening 231. The floor 264 has a ridge 265 formed therein that separates a planar section of the floor 264 from a sloped, curved section of the floor 264. The curved section is actually formed by the beveled edge 252 which provides a rounded surface to facilitate positioning of one free end of the clip member 200 along the floor 264 so that a locking lip 202 of the clip member 200 abuts and is locked in place by the ridge formed across the floor 264.

Figure 5:
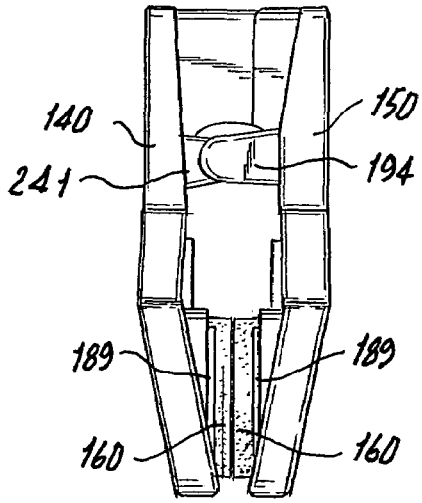
FIG. 5 is an end elevation view of one clamp assembly in a closed position.
Figure 6:
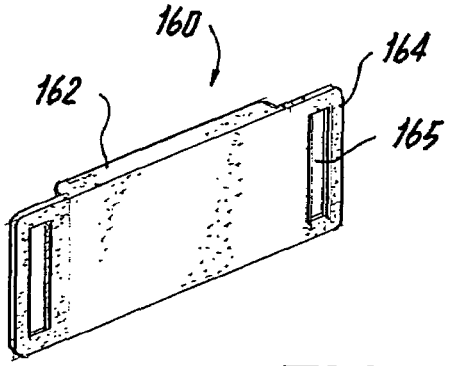
FIG. 6 is a perspective view of a resilient pad according to a first embodiment for installation in the clamp assembly of FIG. 2.
Figure 7:
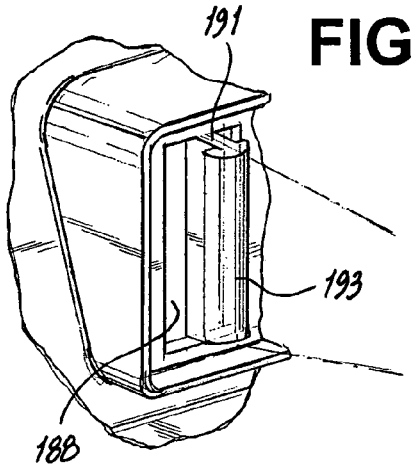
FIG. 7 is an enlarged sectional view of a portion of an inner clamping surface showing one clamping post.
Figure 8:
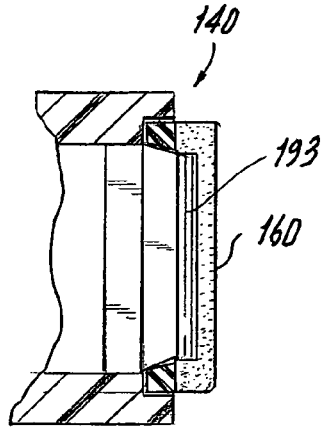
FIG. 8 is a partial cross-sectional view taken along the line 8—8 of FIG. 3.

The gripping features 160 are shown best in FIGS. 4–6. As shown in the views of FIGS. 4 and 6, each of the gripping features 160 is in the form of a removable resilient pad like member that is formed of a resilient friction material that positively engages the garment. As understood, the resilient pad 160 cooperates with the facing resilient pad 160 to positively grip the garment when the front and rear clamp members 140, 150 are in a garment clamping position.

Each of the resilient pads 160 has a base section 162 that is generally rectangular in shape and defines the surface against which the garment is applied. In other words, the base section 162 includes the primary surface which engages and grips the garment. The pad also has a pair of flexible flange like members 164 that are formed at the ends of the base section 162. The thickness of the pad in the flange-like sections 164 is less than the thickness of the base section 162. The flange-like sections 164 have openings 165 formed therein to permit reception of the head and posts of the respective platform of either clamp member 140, 150. The openings 165 thus have a complementary shape of the respective post to permit reception thereof and thus, in the illustrated embodiment, the opening 165 has a rectangular shape. Since the flange-like sections 164 have a height that is less than a height of the base section 162, a shoulder 167 is formed therebetween. Preferably, the opening 165 is generally centrally formed in the flange-like section 164 and the portion of the section 164 that is more distal (away from the base section 162) is the section that is readily more flexible than the portion of the flange-like section 164 that is adjacent the base section 162. While the front face of the pad 160 that engages the clothing has a stepped appearance due to the formation of the shoulder 167, the opposite rear face of the pad 160 is substantially planar so as to permit the pad 160 to seat on and lay against the planar floor of the respective platform.

While the illustrated base section 162 has a rectangular shape, it will be appreciated that the base section 162 can have a number of other shapes, including oblong or oval. It will further be appreciated that the base section 162 can be constructed so that it has several shapes that are interconnected along its length. For example, the base section 162 can be formed of a plurality of circles that are interconnected at points thereof.

In addition, the size and location of the openings 165 can vary depending upon the particular application and depending upon the shape and size of the post which is received therein. For example, instead of one long opening 165, as illustrated, the opening 165 can be formed of two or more smaller openings which receive the same number of distinct posts.

The resilient pads 160 are formed from any number of different materials that provide the desired gripping characteristics. Preferably, the flange-like section 164 and the base section 162 are formed of the same material.

For example, one type of materials that are particularly suited for frictionally engaging a garment placed between the two pads 160 are block copolymers having discreet block segments of styrene monomer units and rubber monomer units. These materials have the common quality of providing a high co-efficient of friction when used in combination with slippery clothing materials, such as rayon, polyester, and linen. This family of block copolymers generally breaks down into two types: polymers which include unsaturated rubber monomer units and polymers which include saturated rubber monomer units. Specific examples of polymers employing unsaturated rubber monomer units include a structure that is linear in nature (A-B-A type). These polymers include styrene-butadiene-styrene (S-B-S) and styrene-isoprene-styrene (S-I-S).

The other subcategory of acceptable resilient frictional materials incorporates saturated rubber monomer units. Those compounds include linear styrene-ethylene/butylene-styrene (S-EB-S). In addition to the linear (A-B-A) polymers, there are specialized polymers of the radial $(A\text{-}B)_n$ type. Some examples include $(\text{styrene-butadiene})_n$, $(S\text{-}B)_n$, or $(\text{styrene-isoprene})_n$, $(S\text{-}I)_n$. Further polymers of the diblock type have been found acceptable. Some example include styrene-butadiene (S-B), styrene-ethylene/propylene (S-EP), and styrene-ethylene/butylene (S-EB). Each block segment of the above mentioned polymers can be 100 monomer units or more.

Materials that are particularly preferred to construct the pads 160, 170 are commercially available from the Shell Chemical Company under the trade name KRATON. KRATON polymers come in a number of different grades with the preferred grades being G grade and D grade; however, it will be appreciated that other grades are available and are suitable for the present intended use.

Other types of resilient friction materials that can be used for the gripping pads are tacky materials, such as flexible polyvinyl chloride and polypropylene.

Referring to FIGS. 1–8, the resilient pads 160 are mated to the clamp members 140, 150 in such a way that the resilient pads 160 can be easily inserted on to the posts and removed therefrom. For sake of brevity, only the coupling between the resilient pad 160 and the front clamp member 140 is described below with the understanding that the coupling of the resilient pad 160 to the rear clamp member 150 is the same. To couple the pad 160 to the front clamp member 140, the pad 160 is positioned so that the rear face is facing down towards the planar floor and the pair of openings 165 are aligned with the heads 193 and a force is applied to the pad 160 in a direction towards the platform 180 so as to insert the pair of heads 193 within the openings 165. The resiliency of the flange-like members 164 permits these members to be flexed and otherwise bent to accommodate the insertion of the heads 193.

Since the heads 193 have a curved (rounded) or beveled shape, this type of construction makes it easier for the pad to be inserted on the posts 189. The distalmost flange-like section 164 is received between the post 189 and one end edge of the raised lip 185. The relative heights of the post 189 and the thickness of the flange-like member 164 are selected so that when inserted, the shoulder 167 formed on an underside of the head 193 and between the head 193 and post 189 are selected so that in the retained position, the head 193 clears the opening 165, with the rounded peripheral edge of the head 193 seating against the top surface of the flange-like members 164. The flange-like member 164 is flexible and can expand to accommodate the head 193 as by the size of the opening 164 increasing due to the flexing of the flange-like member 164, whereby the head 193 is received therein. Once the head 193 clears the opening 164, the resiliency of the flange-like member 164 results in the flange-like member 164 attempting to return to its original form, whereby the head 193 seats against the pad in the flange-like member 164 and retains the pad 160 on the platform 180. The pad 160 is not easily removed from the platform 180 due to the head 191 creating an interference that restricts the removal of the pad 160 from the platform 180.

The other side of the pad 160 is locked into place in the same manner. More specifically, the other opening 165 is aligned with the other post 189 and head 193 and in the same manner as described above, the other head 193 is inserted into and through the opening 165.

When the pad 160 is securely held and retained on the clamp member 140, the base section 162 of the pad 160 is disposed between the posts 189 and can act as an inner clamping surface pad that contacts and helps to grip clothing that is placed between the clamp members 140, 150 and the entire pad 160 is contained within the lip 185 thereof. To remove the pad 160, the user simply needs to pry or otherwise lift the ends of the pad 160 so that the head 193 is forced through the opening 165 which is possible since the pad 160 (the flange-like member 164) is easily deformable to accommodate removal of the pad 160. This permits the pad 160 to be easily interchanged with another one of the same type or of a different type, e.g., a pad with different material characteristics, such as hardness, or different structural dimensions, e.g., increased thickness of the base section 162.

As is known, each grip assembly 130 also includes the movable clip member 200 that is movable between an open position and a closed position. The exemplary clip member 200 is formed of metal and is generally U-shaped with a first section that travels within a guide track formed on an exterior surface of the rear clamp member 150 and a second section that travels within a guide track formed in the exterior surface of the front clamp member 140. In the open position, the second section of the clip member 160 engages a beveled feature of the guide track formed in the exterior surface of the front clamp member 140 so that the front and rear clamp members 140, 150 are locked in the closed position with the article of clothing being securely held therebetween.

The locking member 200 is formed of two resilient arms 204, 206 with the first resilient arm 204 being the first section that seats against the exterior surface of the rear clamp member 150 and the second resilient arm 206 being the second section that seats against the exterior surface of the front clamp member 140. The first resilient arm 204 has a length that is greater than a length of the second resilient arm 206. The locking lip 202 is formed on an inner face of the second resilient arm 206. Typically, the locking member 200 is formed of metal.

The hanger 100 is assembled by first aligning the front clamp member 140 relative to the rear clamp member 150 and more specifically, the front clamp member 140 is positioned so that the cradle ends 241 of the posts 240 are placed in contact with the vertical wall 190 of the rear clamp member 150. In other words, the front clamp member 140 is positioned so that the vertical wall 190 is received within the cradle ends 241 of the posts 240 with the posts 240 being disposed between the stops 194. In this position, the opening 196 and the opening 231 are generally aligned with one another to permit the clip member 200 to be received therethrough. The first resilient arm 204 is first inserted through the opening 231 of the front clamp member 140 and then is disposed through the opening 196 of the rear clamp member 150 and is manipulated downward so that the first resilient arm 204 is disposed within the second recessed section 220.

At a free end thereof, the first resilient arm 204 has a barb 205 formed on an inner surface thereof which is intended to engage an edge formed at the end of the planar surface 222 near the slot 188. The second resilient arm 206 is disposed within the second recessed section 262 and seats against the floor 264 with the locking lip 202 engaging the ridge 265.

The clip member 200 acts as a biasing member that serves to bias the front and rear clamp members 140, 150 toward one another, while permitting the front clamp member 140 to pivot relative to the rear clamp member 150. The front clamp member 140 is pivoted open by applying a force to the top end 142 of the front clamp member 140 to cause the distal cradle ends 241 to pivot about the vertical wall 190. When the applied force is removed, the biasing force of the clip member 200 causes the front clamp member 140 to close. When the front and rear clamp members 140, 150 are in the closed clamped position, the base sections 162 of the pads 160 are in contact with one another and preferably are aligned so that the ends and sides thereof generally align with one another.

The body portion 110, including the grip assemblies 130 with the exception of the front clamp member 140 and the clip member 200, is preferably made as a single piece, molded in plastic using a plastic injection molding machine, as understood by those skilled in the art. Any appropriate plastic can be used, such as styrene, which provides a clear, virtually transparent hanger and alternatively, the hanger 100 can be molded using polypropylene, such as H.I. styrene polypropylene, polypropylene, polyvinylchloride, ABS or other suitable thermoplastics and/or mixtures thereof. As understood by those skilled in the art, the plastic mixture used to mold the hangers can include additional resins for added strength and reinforcement.

The illustrated garment hanger 100 is of a swivel hook type construction in that the hook member 120 is swivably or pivotally attached to the body portion 110 at a location that is generally at a midpoint along the body portion 110. The hook member 120 is pivotally received within a bore that is formed in a base structure that is integrally attached at one end to an upper edge 111 of the body portion 110. The bore therefore has a complementary shape as the hook member 120 and thus, for the illustrated embodiment, the bore is annular in shape to complement the circular shape of the hook member 120.

There are a number of advantages that are realized with the present hanger 100. For example, the resilient pads 160 that form a part thereof provide not only the desired friction gripping characteristics that ensures that garments are securely held therebetween; but also the pads 160 offer snap-fit ease of insertion and removal. More specifically, the pads 160, 170 are easily coupled to respective front and rear clamp members 140, 150 in a snap fit manner.

Figure 9:
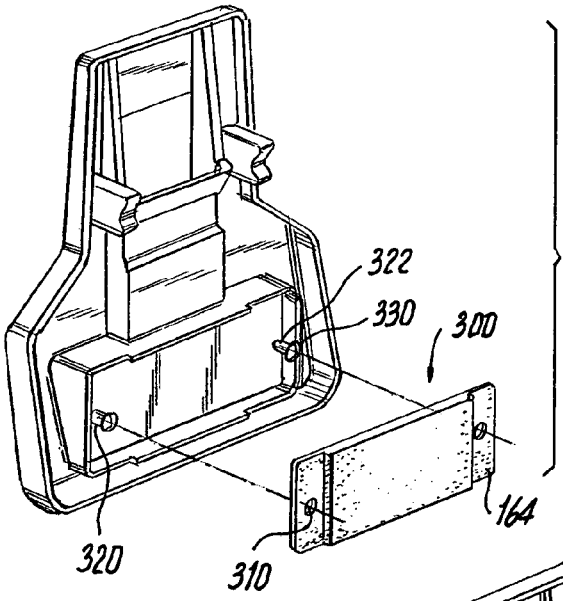
FIG. 9 is a exploded perspective view of a front clamp member according to another embodiment with a pad according to another embodiment.

Now turning to FIG. 9, a resilient pad 300 according to another embodiment is illustrated. The resilient pad 300 is similar to the resilient pad 160 with the resilient pad 300 having a pair of locking openings 310 instead of the locking slots 165 to receive locking protrusions 320 that replace the elongated locking post 189 of the earlier embodiment. More specifically, each protrusion 320 is in the generally cylindrically shaped base section 322 that terminates in a locking feature 330 formed at a distal end of the base section 322. The locking feature 330 includes a generally frusto-conically shaped portion or rounded portion that extends beyond the cylindrically shaped base section 322 such that a shoulder 332 is defined between base section 322, where the locking feature 330 extends beyond the base section 322. The shoulder 332 can be an annular shoulder or it can be defined by a plurality of arcuate segments that are not continuous with another (gaps formed between the segments). To increase the flexibility of the locking feature 330, an underside thereof can be at least partially cut away to remove material and thereby increasing the flexing ability thereof.

In this embodiment, the locking posts 320 mate with discrete openings 310 (e.g., circular openings) that are formed through the flange-like members 164 of the pad 300. Each of the openings 310 has a shape that is complementary to the cross-sectional shape of the locking posts 320. When the locking feature 330 is inserted into the corresponding opening 310, the flange-like sections 164 of the pad 300 flexes around the openings 310 to permit reception of the locking feature 330 and then after the locking feature 330 clears the openings 310, the resilient nature of the pad 300 causes the pad 300 to return to its original form around the locking posts 320, whereby the pad 300 is securely held in place on the platform 180.

Since the maximum diameter of the locking feature 330 near the shoulder thereof is greater than the diameter of the opening 310, the locking feature 330 is placed into an interference fit after it is inserted into and clears the opening 310. In this manner, the resilient pad 300 securely mates and is retained on each of the front and rear clamp members.

The number of posts 320 and the spacing therebetween is variable. For example, there can be three or more posts 320 instead of a pair of posts 320. The posts 320 preferably are aligned in a linear manner along the base section 322. As with the earlier disclosed embodiment, the resilient pad 300 can be removed from the respective clamp member by simply prying the pad 300 off of the locking posts 320.

Figure 10:
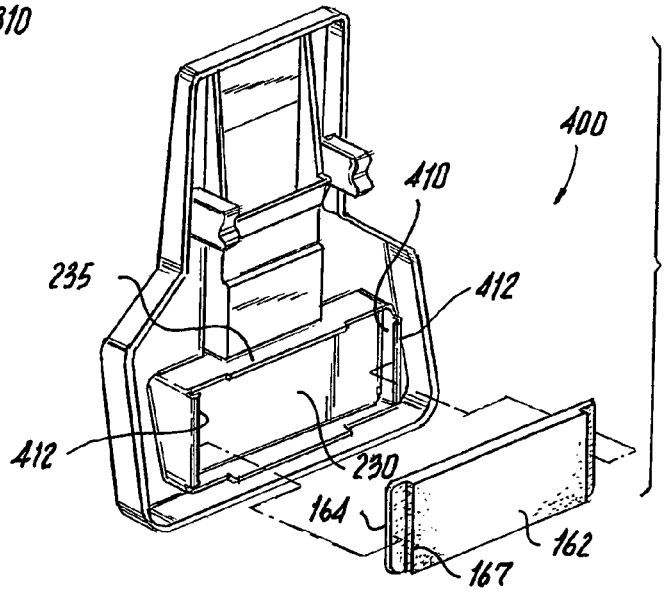
FIG. 10 is an exploded perspective view of a front clamp member according to another embodiment with a pad according to another embodiment.

Now turning to FIG. 10 in which a clamping member according to another embodiment is illustrated. In this embodiment, a pad 400 is provided and is similar to the other pads in that it includes a base section 162 and a pair of flanges 164; however, unlike the other embodiments, the flanges 164 do not contain any openings but rather they are flexible regions of the pad. In this embodiment, each of the platforms 180, 230 contain pad retaining members 410 formed at opposite ends of the respective platform. Each retaining member 410 is in the form of a vertical wall that has an inward lip portion 412 formed at one end thereof.

The retaining members 410 are intended to engage and retain the pad 400 in place on the respective platform. More specifically, the lip portions 412 of the vertical wall 410 engage and catch the flanges 164 so as to securely locate and hold the pad 400 on the platform. To insert the pad 400, the user simply inserts one flange 164 underneath one lip portion 412 such that the lip portion 412 seats against the shoulder 167 and then the pad is laid across the clamp platform to permit the other flange 164 to be bent so as to dispose the other flange 164 underneath the lip portion 412, with the lip portion 412 seating against the shoulder 167. The lip portions prevent the pad 400 from freely lifting off the platform 230 and the lip 235 prevents excess movement of the pad while sitting on the platform. When the pad 400 is in this retained position for use, the base section 162 extends above the lip 235 and the lips portions 412 since it is constructed to have such a height and therefore, during use, the outer surface of the base section 162 is the surface that contacts the garment. The pad 400 can easily be inserted and removed from the clamp member to permit replacement thereof; however, the pad 400 is held securely in place during use as a result of lips 412 and therefore, it suitably functions as a gripping member for engaging the garment.

While this invention has been particularly shown and described with references to preferred embodiments thereof, it will be understood by those skilled in the art that various changes in form and details may be made therein without departing from the scope of the invention encompassed by the appended claims.

What is claimed is:

1. A garment hanger comprising:

a cross-bar having first and second ends;

a hook member coupled to the cross-bar to permit hanging of the garment hanger;

a first clamp assembly disposed at the first end of the cross bar and a second clamp assembly disposed at the second end of the cross-bar, wherein each of the first and second clamp assemblies includes first and second clamp members that are pivotably coupled to one another and urged toward one another by a biasing element; each of the first and second clamp members having an inner clamp surface that has a pair of locking posts extending outwardly from the inner clamp surface, each locking post having a locking feature formed at a distal end thereof; and a resilient pad coupled to each inner clamp surface in a removable manner by inserting the locking features of the locking posts into and through complementary openings formed in the resilient pad such that the locking features clear an outer face of the resilient pad and form an interference fit therewith to securely hold the resilient pad on the inner clamp surface and prevent the resilient pad from readily being lifted off of the inner clamp surface.

2. The hanger of claim 1, wherein the resilient pad has a base section for contacting and gripping the garment and a pair of flexible flange sections formed at each end of the base section, the openings being formed in the flexible flange sections.

3. The hanger of claim 2, wherein the base section has a thickness greater than a thickness of the flange sections.

4. The hanger of claim 1, wherein the locking feature at the distal end comprises an enlarged section.

5. The hanger of claim 4, wherein the locking feature is a rounded head that has edges that extend beyond the distal end of the locking post.

6. The hanger of claim 4, wherein the locking feature is a pair of slanted edges that come together to an apex, the edges having opposite free edges that define a locking shoulder that create the interference fit once the locking shoulder is inserted into the opening and clears the one face of the pad.

7. The hanger of claim 1, wherein the inner clamp surface has a raised platform that includes a peripheral lip extending therearound, the pair of openings being formed through a floor of the raised platform, the locking posts being arranged such that one locking post extends across one opening formed in the raised platform to permit a degree of flexing of the post.

8. The hanger of claim 7, wherein the locking post is an elongated ridge that is integral to the platform and extends across one opening from one edge of opening to another edge thereof.

9. The hanger of claim 8, wherein the locking posts are formed parallel to one another and to ends of the peripheral lip.

10. The hanger of claim 7, wherein each locking post has a tapered construction.

11. The hanger of claim 7, wherein the locking posts has a width less than a width of the one opening such that an open slot is formed on either side of the locking post, the ends of the locking posts being integrally formed with a surrounding web of the platform.

12. The hanger of claim 1, wherein the first clamp member has a vertical wall and the second clamp member includes a pair of clamp posts with cradle-shaped free ends that receive the vertical wall such that the front clamp member pivots about the rear wall.

13. The hanger of claim 12, wherein the vertical wall has a pair of stops formed at ends thereof to limit the degree of travel of the cradle-shaped ends along the vertical wall.

14. The hanger of claim 1, wherein the resilient pad is formed of a resilient friction material that comprises a block co-polymer having discreet block segments of styrene monomer units and rubber monomer units.

15. The hanger of claim 14, wherein the block copolymer has a linear styrene-rubber-styrene structure.

16. The hanger of claim 14, wherein the block copolymer has a radial $(\text{styrene-rubber})_n$ structure.

17. The hanger of claim 14, wherein the rubber monomer unit is selected from the group consisting of butadiene, isoprene, ethylene/butylene or ethylene/propylene.

18. The hanger of claim 1, wherein a coefficient of friction of the resilient pad is sufficiently high to preclude movement under the weight of the garment when a normal clamping force is applied to the two clamping members to move them into a clamping position.

19. The hanger of claim 1, wherein the block copolymer has a diblock (styrene-rubber) structure.

20. The hanger of claim 1, wherein each of the inner clamp surfaces has a raised platform that includes a peripheral lip extending therearound, the locking posts being formed along a floor of the raised platform, the platforms being formed on the respective first and second clamp members such that in a clamping position, the platforms face one another and are substantially parallel to one another.

21. A garment hanger comprising:

a cross-bar having first and second ends;

a hook member coupled to the cross-bar to permit hanging of the garment hanger;

a first clamp assembly disposed at the first end of the cross bar and a second clamp assembly disposed at the second end of the cross-bar, wherein each of the first and second clamp assemblies includes first and second clamp members that are pivotably coupled to one another and urged toward one another by a biasing element; each of the first and second clamp members having an inner clamp surface that has a pair of locking posts extending outwardly from the inner clamp surface, each locking post having a locking feature formed at a distal end thereof; and a resilient pad coupled to each inner clamp surface in a removable manner by inserting the locking features of the locking posts into and through complementary openings formed in the resilient pad such that the resilient pad is securely held on the inner clapm surface by an interference fit between the locking features and one face of the resilient pad, wherein the resilient pad has a base section for contacting and gripping the garment and a pair of flexible flange sections formed at each end of the base section, the openings being formed in the flexible flange sections, wherein a shoulder is formed between the base section and each flange section, the locking feature being disposed between the shoulder and one end of the pad, and wherein an upper surface of the base section lies in a plane that is free of impingement by the locking feature.

22. A garment hanger comprising:

a cross-bar having first and second ends;

a hook member coupled to the cross-bar to permit hanging of the garment hanger;

a first clamp assembly disposed at the first end of the cross bar and a second clamp assembly disposed at the second end of the cross-bar, wherein each of the first and second clamp assemblies includes first and second clamp members that are pivotably coupled to one another and urged toward one another by a biasing element; each of the first and second clamp members having an inner clamp surface that has a pair of flexable locking posts formed therein, each locking post having a locking feature formed at a distal end thereof, the locking feature having a substantially triangular cross section; and a resilient pad coupled to each inner clamp surface in a removable manner, the resilient pad having a stepped construction, with a pair of locking apertures formed therethrough in flexible end flange sections of the pad, the pad being coupled to the inner clamp surface as a result of inserting the locking features into the locking apertures such that the locking feature clears one face of the pad and forms an interference fit therewith to prevent the pad from readily being lifted off of the platform.

23. A garment hanger comprising:

a cross-bar having first and second ends;

a hook member coupled to the cross-bar to permit hanging of the garment hanger;

a first clamp assembly disposed at the first end of the cross bar and a second clamp assembly disposed at the second end of the cross-bar, wherein each of the first and second clamp assemblies includes first and second clamp members that are pivotably coupled to one another and urged toward one another by a biasing element; each of the first and second clamp members having an inner clamp surface that has a pair of openings formed therethrough with a pair of flexible locking posts extending at least partially across each opening; and a resilient pad coupled to each inner clamp surface in a removable manner, the resilient pad having a garment contacting section and a plurality of locking apertures, one locking aperture receiving a locking feature formed at a distal end of the locking post so that a portion of the pad is pinched between the locking feature and the inner clamp surface such that it is securely held therebetween.

24. The hanger of claim 23, wherein the locking feature is mushroom shaped.

25. The hanger of claim 23, wherein the locking feature has a frusto-conical shape.

26. The hanger of claim 23, wherein the resilient pad comprises a base section that contacts the garment in use and a pair of flexible end flange sections where the plurality of locking apertures are formed.

27. The hanger of claim 23, wherein the locking post has a cylindrically shaped base and an enlarged head that acts as the locking feature.

28. The hanger of claim 26, wherein the resilient pad has a weakened region, defined in part by the locking aperture formed in the flexible end flange section to permit flexing of the end flange section in the weakened region.

29. The hanger of claim 23, wherein the resilient pad has a stepped construction defined by a first section that has a first thickness and is intended to contact the garment and a plurality of second sections that have a second thickness less than the first thickness so that when the locking post is received into the locking aperture such that the locking feature pinches the portion of the pad, the locking feature lies below a plane containing an upper surface of the garment contacting section of the pad.

30. A garment hanger comprising:

a cross-bar having first and second ends;

a hook member coupled to the cross-bar to permit hanging of the garment hanger;

a first clamp assembly disposed at the first end of the cross bar and a second clamp assembly disposed at the second end of the cross-bar, wherein each of the first and second clamp assemblies includes first and second clamp members that are pivotably coupled to one another and urged toward one another by a biasing element; each of the first and second clamp members having an inner clamp surface that has a platform with a pair of walls formed at ends thereof, each end wall having an inwardly directed lip formed at a distal end thereof, the lips of end walls facing inwardly toward one another and extending over the platform; and a resilient pad coupled to each inner clamp surface in a removable manner, the resilient pad having a flange formed at each end thereof for insertion underneath the lips of the end walls, the resilient pad being securely held on the platform by having each flange disposed underneath the lip which pinches the flange against the platform resulting in the pad being securely held on the platform.

31. The hanger of claim 30, wherein the inner clamp surface includes a pair of opposing side walls that are formed on opposite sides of the platform with the end walls extending therebetween at the ends of the platform, the end walls limiting lateral movement of the pad, while the side walls limit up-down movement of the pad.

* * * * *